US009196192B2

(12) United States Patent
Kim

(10) Patent No.: US 9,196,192 B2
(45) Date of Patent: Nov. 24, 2015

(54) DISPLAY DEVICE, POWER CONTROL DEVICE, AND DRIVING METHOD THEREOF

(71) Applicant: Samsung Display Co., Ltd., Yongin, Gyeonggi-Do (KR)

(72) Inventor: Jin-Woo Kim, Yongin (KR)

(73) Assignee: Samsung Display Co., Ltd., Samsung-ro, Giheung-Gu, Yongin-Si, Gyeonggi-Do (KR)

( * ) Notice: Subject to any disclaimer, the term of this patent is extended or adjusted under 35 U.S.C. 154(b) by 188 days.

(21) Appl. No.: 13/670,683

(22) Filed: Nov. 7, 2012

(65) Prior Publication Data

US 2013/0335396 A1 Dec. 19, 2013

(30) Foreign Application Priority Data

Jun. 14, 2012 (KR) ..... 10-2012-0063856

(51) Int. Cl.
*G09G 5/00* (2006.01)
*G09G 3/32* (2006.01)

(52) U.S. Cl.
CPC ..... *G09G 3/3208* (2013.01); *G09G 3/3233* (2013.01); *G09G 2300/0852* (2013.01); *G09G 2300/0861* (2013.01); *G09G 2330/028* (2013.01)

(58) Field of Classification Search
CPC ..... G09G 3/3208; G09G 3/3233; G09G 2330/028; G09G 2300/0852; G09G 2300/0861
USPC ..... 345/76–100, 204–213, 690, 697; 313/504; 315/169.3; 361/18, 679.21
See application file for complete search history.

(56) References Cited

U.S. PATENT DOCUMENTS

| | | | | |
|---|---|---|---|---|
| 4,047,097 | A * | 9/1977 | Gyugyi et al. | 323/211 |
| 4,618,810 | A * | 10/1986 | Hagerman et al. | 318/803 |
| 5,129,060 | A * | 7/1992 | Pfeiffer et al. | 345/563 |
| 5,270,687 | A * | 12/1993 | Killebrew, Jr. | 345/602 |
| 7,518,577 | B2 * | 4/2009 | Akimoto et al. | 345/76 |
| 7,974,793 | B2 * | 7/2011 | Weddle | 702/58 |
| 2002/0067318 | A1 * | 6/2002 | Matsuzaki et al. | 345/1.1 |
| 2002/0180675 | A1 * | 12/2002 | Tobita et al. | 345/87 |
| 2006/0061291 | A1 * | 3/2006 | Lee et al. | 315/169.3 |
| 2006/0145960 | A1 * | 7/2006 | Koga et al. | 345/76 |
| 2006/0221028 | A1 * | 10/2006 | Aoki | 345/88 |
| 2007/0216613 | A1 * | 9/2007 | Ogura et al. | 345/76 |
| 2008/0158218 | A1 * | 7/2008 | Kim | 345/212 |
| 2008/0218450 | A1 * | 9/2008 | Park | 345/76 |
| 2008/0238328 | A1 * | 10/2008 | Shin et al. | 315/169.3 |

(Continued)

FOREIGN PATENT DOCUMENTS

| | | | |
|---|---|---|---|
| JP | 07-320483 | A | 12/1995 |
| JP | 2004-282877 | A | 10/2004 |

(Continued)

*Primary Examiner* — Prabodh M Dharia
(74) *Attorney, Agent, or Firm* — Robert E. Bushnell, Esq.

(57) ABSTRACT

A display device includes a plurality of pixels and a power supply controller that includes a first power supply source unit supplying a high power supply voltage, and a second power supply source unit supplying a low power supply voltage. The high power supply voltage is different from the low power supply voltage. The power supply controller connects one of the first and second power supply source units to the plurality of the pixels. The one of the first and second power supply source units is switched to another of the first and second power supply source units at a switching time, at which the one of the first and second power supply source units stops operation.

25 Claims, 6 Drawing Sheets

(56) References Cited

U.S. PATENT DOCUMENTS

| | | | | |
|---|---|---|---|---|
| 2008/0252570 | A1* | 10/2008 | Kwon | 345/76 |
| 2008/0291223 | A1* | 11/2008 | Yamazaki et al. | 345/690 |
| 2009/0109147 | A1* | 4/2009 | Park et al. | 345/76 |
| 2009/0116305 | A1* | 5/2009 | Son et al. | 365/189.09 |
| 2009/0122218 | A1* | 5/2009 | Oh et al. | 349/58 |
| 2009/0243978 | A1* | 10/2009 | Yamamoto et al. | 345/76 |
| 2009/0309865 | A1* | 12/2009 | Kohno et al. | 345/213 |
| 2010/0220039 | A1* | 9/2010 | Park et al. | 345/76 |
| 2010/0259531 | A1* | 10/2010 | Ono | 345/212 |
| 2011/0057916 | A1* | 3/2011 | Cheng et al. | 345/211 |
| 2011/0102413 | A1* | 5/2011 | Hamer et al. | 345/213 |
| 2011/0108842 | A1* | 5/2011 | Yamazaki et al. | 257/59 |
| 2011/0141096 | A1* | 6/2011 | Moriya et al. | 345/211 |
| 2011/0141098 | A1* | 6/2011 | Yaguma et al. | 345/212 |
| 2011/0157135 | A1* | 6/2011 | Lee et al. | 345/211 |
| 2011/0261044 | A1* | 10/2011 | Shin et al. | 345/211 |
| 2012/0068915 | A1* | 3/2012 | Yamazaki | 345/76 |
| 2012/0126129 | A1* | 5/2012 | Nakatsugawa et al. | 250/369 |
| 2012/0139901 | A1* | 6/2012 | Hwang | 345/419 |
| 2012/0162176 | A1* | 6/2012 | Kim et al. | 345/211 |

FOREIGN PATENT DOCUMENTS

| | | | |
|---|---|---|---|
| KR | 10-2011-0013693 | A | 2/2011 |
| KR | 10-2011-0113383 | A | 10/2011 |

* cited by examiner

DISPLAY DEVICE, POWER CONTROL DEVICE, AND DRIVING METHOD THEREOF

CROSS-REFERENCE TO RELATED APPLICATION

This application claims priority to and the benefit of Korean Patent Application No. 10-2012-0063856 filed in the Korean Intellectual Property Office on Jun. 14, 2012 the entire contents of which are incorporated herein by reference.

BACKGROUND OF THE INVENTION

1. Field of the Invention

The present invention relates to a display device, a power control device, and a driving method thereof.

2. Description of the Related Art

Recently, for supplying driving power of a display device, a power supply of a high rated power and a power supply of a low rated power have been used. When the display device displays a simple widget or a clock, the low power supply is used, and when a general motion picture or an image having a high grayscale is displayed, the high power supply is used, thereby reducing power consumption of the display device.

A user may select a power saving mode for the display device to use the low power supply or may select a general mode for the display device to use the high power supply. While the display device emits light, if the power supply of the display device is converted from the high power supply into the low power supply or from the low power supply to the high power supply, a supply conversion moment may be recognized by eyes of the user.

Also, when the display device is converted from the power saving mode using the low power supply into the general mode using the high power supply, if the conversion of the power supply is slower than the conversion of the image data, an overload is generated to the lower power supply such that overcurrent protection (OCP) may be initiated or an internal circuit may be damaged.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention provides a display device, a power control device, and a driving method thereof to not generate an overload to a low power supply and not allow a moment that a power supply of a display device is converted to be recognizable by a user.

A display device according to an exemplary embodiment of the present invention includes: a plurality of pixels; a power supply controller transmitting a high power supply voltage and a low power supply voltage to the plurality of the pixels. a high power supply voltage and a low power supply voltage to the plurality of the pixels. the power supply controller comprising a first power supply source unit supplying the high power supply voltage, and a second power supply source unit supplying the low power supply voltage. The power supply controller connects one of the first and second power supply source units to the plurality of the pixels. The one of the first and second power supply source units is switched to another of the first and second power supply source units at a switching time at which the one of the first and second power supply source units stops operation. The switching time is after a start time of said another of the first and second power supply source units at which said another of the first and second power supply source units starts operation. Said another of the first and second power supply source units has a start-up period after the start time. The switching time is after the start-up period of said another of the first and second power supply source units.

The one of the first and second power supply source units may start operation at a time that a selection signal is changed into a level selecting the one of the first and second power supply source units.

The operation of the one of the first and second power supply source units may stop at a time that a level of the first power supply voltage of the one of the first and second power supply source units begins to decrease.

Said another of the first and second power supply source units may start to operation at a time that a selection signal is changed into the level for selecting said another of the first and second power supply source units.

The operation of said another of the first and second power supply source units may stop at the time that a level of the first power supply voltage of said another of the first and second power supply source units begins to decrease.

A level of the power supply voltage of the one of the first and second power supply source units begins to decrease at the switching time. A driving voltage of an organic light emitting diode (OLED) included in the plurality of pixels may be reset at the switching time.

A power control device according to another exemplary embodiment of the present invention includes: a delay driver outputting a mode signal delayed from a selection signal instructing conversion of a power supply source; a NAND gate receiving the selection signal and the mode signal to generate a first enable signal of an on-voltage; a first power supply source unit operated according to the first enable signal to output a high power supply voltage as a first power supply voltage to provide a driving current of a pixel; an OR gate receiving the selection signal and the mode signal to generate a second enable signal of the on-voltage; and a second power supply source unit operated according to the second enable signal to output a low power supply voltage as the first power supply voltage.

The delay driver may monitor a first power supply voltage control signal changing the first power supply voltage into a logic low level or a logic high level, and may output the mode signal delayed from the selection signal by using the first power supply voltage control signal.

The delay driver may output the mode signal at the time that the level of the first power supply voltage is decreased after a predetermined time from the time that the level of the selection signal is changed.

The predetermined time may be a start-up period during which the voltage of the first power supply source unit is increased.

The first enable signal of the on-voltage may be generated at the time that the level of the selection signal is changed.

The NAND gate may generate the first enable signal of an off-voltage stopping the operation of the first power supply source unit at the time that the first power supply voltage level is decreased.

The predetermined time may be a start-up period during which the voltage of the second power supply source unit is increased.

The second enable signal of the on-voltage may be generated at the time that the level of the selection signal is changed.

The OR gate may generate the second enable signal of the off-voltage stopping the operation of the second power supply source unit at the time that the first power supply voltage level is decreased.

A NOT gate generating a reverse signal of the mode signal, a first AND gate receiving the reverse signal of the mode signal and the first power supply voltage control signal to change the first power supply voltage into the logic low level and the logic high level to generate the first output signal, and a first transistor transmitting the high power supply voltage of the first power supply source unit to the first node supplying the first power supply voltage to the pixel according to the first output signal of the first AND gate may be further included.

The first power supply voltage control signal may be applied with the off-voltage during a reset period for reversing a voltage difference of the first power supply voltage and the second power supply voltage to reset the driving voltage of the organic light emitting diode (OLED) included in the pixel.

A second AND gate receiving the mode signal and the first power supply voltage control signal to generate the second output signal, and a second transistor transmitting the low power supply voltage of the second power supply source unit to the first node according to the second output signal of the second AND gate, may be further included.

A third transistor grounding the first node supplying the first power supply voltage to the pixel according to the reverse signal of the first power supply voltage control signal may be further included.

A fourth transistor transmitting the second power supply voltage to the second node supplying the second power supply voltage to the pixel according to the second power supply voltage control signal to change the second power supply voltage to provide the pixel driving current into the logic low level and the logic high level, and a fifth transistor grounding the second node according to the reverse signal of the second power supply voltage control signal, may be further included.

The second power supply voltage control signal may be applied with the off-voltage during a light emitting period for light-emitting the pixel.

A driving method of a power control device according to another exemplary embodiment of the present invention includes: supplying a first power supply voltage and a second power supply voltage providing a driving current of a plurality of pixels to the plurality of pixels; changing a level of a selection signal instructing conversion of the power supply source units generating the first power supply voltage; and converting the power supply source units at a time that a level of the power supply voltage of one of the power supply source units is decreased after a predetermined time from a time that the level of the selection signal is changed.

The converting of the power supply source units may include converting the power supply source units generating the first power supply voltage from a first power supply source unit outputting a high power supply voltage into a second power supply source unit outputting a low power supply voltage.

The predetermined time may be a start-up period during which the level of the second power supply voltage is increased.

Starting an operation of the second power supply source unit at a time that the level of the selection signal is changed may be further included.

Stopping the operation of the first power supply source unit at the time that the level of the first power supply voltage is decreased may be further included.

The converting of the power supply source units may include converting the power supply source units generating the first power supply voltage from a second power supply source unit outputting a low power supply voltage into a first power supply source unit outputting a high power supply voltage.

The predetermined time may be a start-up period during which the level of the first power supply source is increased.

Starting an operation of the first power supply source unit at a time that the level of the selection signal is changed may be further included.

Stopping the operation of the second power supply source unit at the time that the level of the first power supply voltage is decreased may be further included.

The converting of the power supply source units may include reversing a voltage difference of the first power supply voltage and the second power supply voltage to reset the driving voltage of the organic light emitting diode (OLED) included in a plurality of pixels.

A noise that is generated in a screen at an instant that power of the display device is converted may be eliminated, and an overload is not applied to the low power supply such that an erroneous operation of the display device may be prevented.

DETAILED DESCRIPTION OF THE EMBODIMENTS

Figure 1:
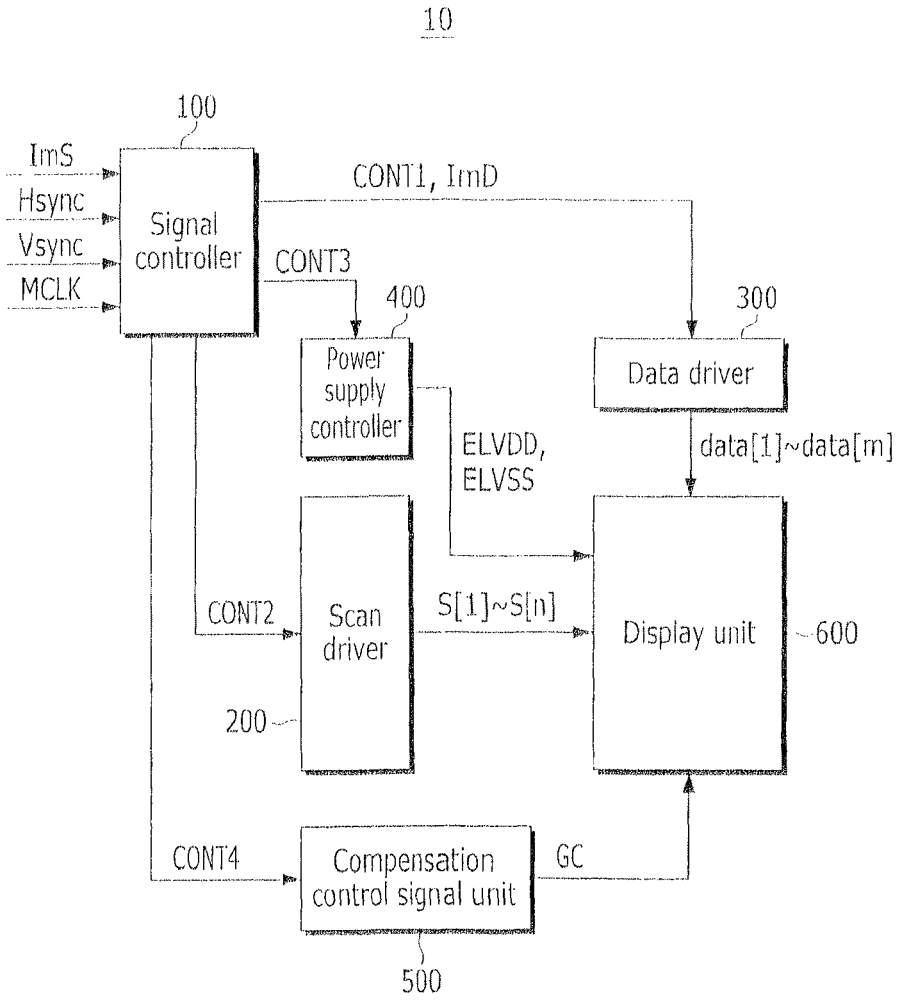
FIG. 1 is a block diagram of a display device according to an exemplary embodiment of the present invention.

Hereinafter, the present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Further, in a plurality of exemplary embodiments, like reference numerals are used for components having the same configuration representatively in a first exemplary embodiment, and other configurations different from the first exemplary embodiment are described in the other exemplary embodiments.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an exemplary embodiment of the present invention.

Referring to FIG. 1, a display device 10 includes a signal controller 100, a scan driver 200, a data driver 300, a power supply controller 400, a compensation control signal unit 500, and a display unit 600.

The signal controller 100 receives a video signal ImS and a synchronization signal input from the outside. The input video signal ImS includes luminance information of a plurality of pixels. The luminance has a predetermined number of grays, for example 1024 ($2^{10}$), 256 ($2^{8}$), or 64 ($2^{6}$). The synchronization signal includes a horizontal synchronization signal Hsync, a vertical synchronization signal Vsync, and a main clock signal MCLK.

The signal controller 100 generates first to fourth driving control signals CONT1, CONT2, CONT3, and CONT4, and an image data signal ImD, according to the video signal ImS, the horizontal synchronization signal Hsync, the vertical synchronization signal Vsync, and the main clock signal MCLK.

The signal controller 100 divides the video signal ImS by a frame unit according to the vertical synchronization signal Vsync and divides the video signal ImS by a scan line unit according to the horizontal synchronization signal Hsync to generate the image data signal ImD. The signal controller 100 transmits the image data signal ImD to the data driver 300 along with the first driving control signal CONT1.

The display unit 600 includes a display area including a plurality of pixels. In the display portion 600, a plurality of scan lines that extend substantially in a row direction to be almost parallel to each other, a plurality of data lines that extend substantially in a column direction to be almost parallel to each other, a plurality of power lines, and a plurality of compensation control lines are connected to the plurality of pixels. The plurality of pixels are arranged in an approximate matrix form (two-dimensional array) in an area in which the plurality of scan lines and the plurality of data lines cross each other.

The scan driver 200 is connected to the plurality of scan lines, and generates a plurality of scan signals S[1]-S[n] according to the second driving control signal CONT2. The scan driver 200 may sequentially apply the scan signals S[1]-S[n] of the gate on-voltage to the plurality of scan lines.

The data driver 300 is connected to the plurality of data lines, samples and holds the image data signal ImD inputted according to the first driving control signal CONT1, and transmits a plurality of data signals data[1]-data[m] to each of the plurality of data lines. The data driver 300 applies a data signal having a predetermined voltage range to the plurality of data lines to correspond to the scan signal S[1] of the gate on-voltage.

The power supply controller 400 determines the level of a first power supply voltage ELVDD and a second power supply voltage ELVSS according to the third driving control signal CONT3 to supply the level to a power line connected to the plurality of pixels. The first power supply voltage ELVDD and the second power supply voltage ELVSS supply a driving current of the pixel. The power supply controller 400 may generate the first power supply voltage ELVDD as one of the first power supply source and the second power supply source according to a selection signal Select (shown in FIGS. 5 and 6) instructing conversion of the power supply source. At this time, the power supply controller 400 converts the power supply source generating the first power supply voltage ELVDD in synchronization with a time that a level of the first power supply voltage ELVDD is decreased after a start-up period of one of the first power supply source and the second power supply source from a time that a level of a selection signal Select is changed into the started-up power supply source of the first power supply source and the second power supply source.

The compensation control signal portion 500 determines the level of the compensation control signal GC according to the fourth driving control signal CONT4 to apply the level to the compensation control line connected to a plurality of pixels.

Figure 2:
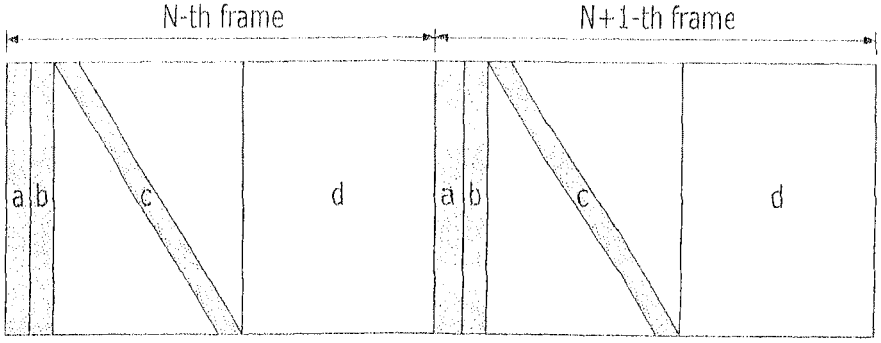
FIG. 2 is a view showing a driving operation of a simultaneous light-emitting mode of a display device according to an exemplary embodiment of the present invention.

FIG. 2 is a view showing a driving operation of a simultaneous light-emitting mode of a display device according to an exemplary embodiment of the present invention.

With reference to FIG. 2, the present invention will be described under the assumption that the display device according to the exemplary embodiment of the present invention is an organic light emitting diode (OLED) display using an organic light emitting diode (OLED). However, the present invention is not limited thereto, and may be applied to various flat panel displays.

One frame period for which one image is displayed in the display portion 600 includes (a) a reset period in which a driving voltage of the organic light emitting diode of a pixel is reset, (b) a compensation period in which a threshold voltage of the driving transistor of the pixel is compensated, (c) a scan period in which data signals are transmitted to each of a plurality of pixels, and (d) a light emitting period in which a plurality of pixels emit light to correspond to the transmitted data signals. In FIG. 2, the symbols a, b, c and d represent a reset period, a compensation period, a scan period, and a light emitting period, respectively.

As illustrated in the drawings, operations for (c) the scan period are sequentially performed for each scan line, but operations for (a) the reset period, (b) the threshold voltage compensation period, and (d) the light emitting period are simultaneously performed together in the entire display portion 600.

Figure 3:
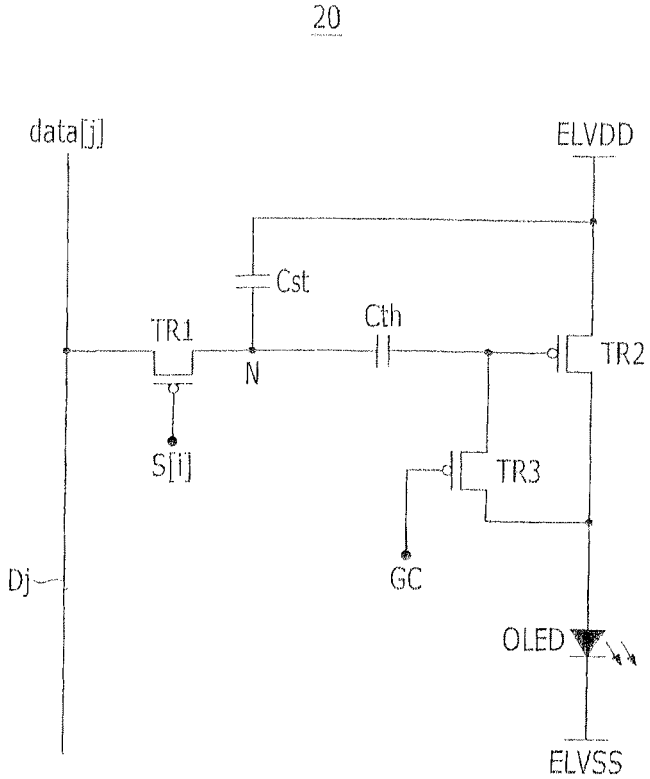
FIG. 3 is a circuit diagram of a pixel according to an exemplary embodiment of the present invention.

FIG. 3 is a circuit diagram illustrating an example of a pixel according to an exemplary embodiment of the present invention.

FIG. 3 shows one example of a pixel according to an exemplary embodiment of the present invention. Any one pixel of a plurality of pixels included in the display device 10 of FIG. 1 is shown.

Referring to FIG. 3, the pixel 20 includes a switching transistor TR1, a driving transistor TR2, a compensation transistor TR3, a compensation capacitor Cth, a storage capacitor Cst, and an organic light emitting diode (OLED).

The switching transistor TR1 includes a gate electrode connected to a scan line, an electrode connected to a data line Dj, and another electrode connected to an input node N. The switching transistor TR1 is turned on by a scan signal S[i] of a gate on-voltage Von applied to the scan line to transmit a data signal data[j] applied to a data line Dj to the input node N.

The driving transistor TR2 includes the gate electrode connected to another electrode of the compensation capacitor Cth, an electrode connected to the first power supply voltage ELVDD, and another electrode connected to an anode of the organic light emitting diode (OLED). The driving transistor TR2 controls a driving current supplied to the organic light emitting diode (OLED).

The compensation transistor TR3 includes the gate electrode connected to the compensation control line, an electrode connected to the gate electrode of the driving transistor TR2, and another electrode connected to the anode of the organic light emitting diode (OLED). The compensation transistor TR3 is turned on/off by the compensation control signal GC.

The compensation capacitor Cth includes an electrode connected to the input node N, and another electrode connected to the gate electrode of the driving transistor TR2.

The storage capacitor Cst includes an electrode connected to the input node N, and another electrode connected to the first power supply voltage ELVDD.

The organic light emitting diode (OLED) includes the anode that is connected to another electrode of the driving transistor TR2 and the cathode that is connected to the second power supply voltage ELVSS. The organic light emitting diode (OLED) can emit light of one of primary colors. Examples of the primary colors may include three primary colors of red, green, and blue, and a desired color may be displayed by a spatial sum or a temporal sum of the three primary colors.

The switching transistor TR1, the driving transistor TR2, and the compensation transistor TR3 may be p-channel field effect transistors. In this case, the gate on-voltage that turns on the switching transistor TR1, the driving transistor TR2, and the compensation transistor TR3 is a logic low level voltage, and the gate off-voltage that turns on the switching transistor TR1, the driving transistor TR2, and the compensation transistor TR3 is a logic high level voltage.

Herein, the p-channel field effect transistor is illustrated, but at least one of the switching transistor TR1, the driving transistor TR2, and the compensation transistor TR3 may be an n-channel field effect transistor. In this case, the gate on-voltage turning on the n-channel field effect transistor is a logic high level voltage, and the gate off-voltage turning off the n-channel field effect transistor is a logic low level voltage.

Figure 4:
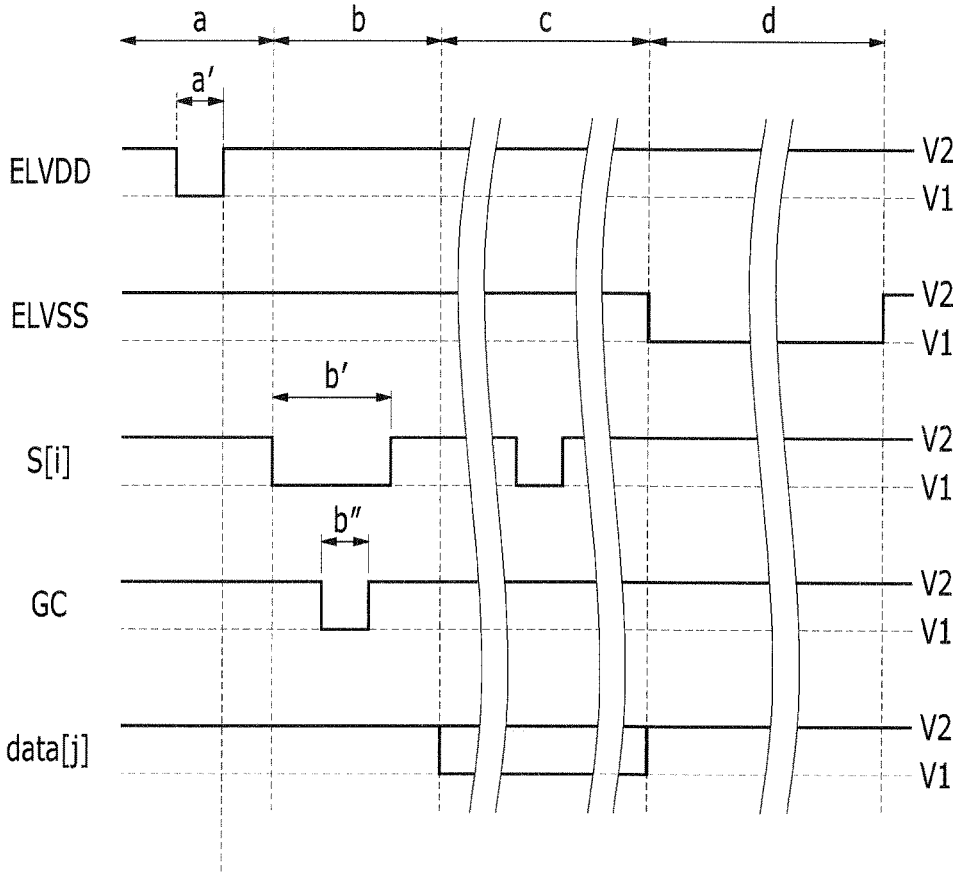
FIG. 4 is a timing diagram of a driving method of a display device according to an exemplary embodiment of the present invention.

FIG. 4 is a timing diagram illustrating a method for driving the display device according to an exemplary embodiment of the present invention.

Referring to FIGS. 3 and 4, the second power supply voltage ELVSS is maintained at the second voltage level V2 for the reset period (a), and the first power supply voltage ELVDD is converted into the first voltage level V1 for a predetermined period (a'). The first voltage level V1 is the logic low level voltage, and the second voltage level V2 is the logic high level voltage (V1<V2). In the predetermined period (a'), the scan signal S[i], the compensation control signal GC, and the data signal data[j] are maintained at the second voltage level V2.

For the reset period (a), a voltage difference between the first power supply voltage ELVDD and the second power supply voltage ELVSS is inverted. Accordingly, the anode voltage of the organic light emitting diode (OLED) becomes higher than the first power supply voltage ELVDD, and from the standpoint of the driving transistor TR2, the anode of the organic light emitting diode (OLED) becomes a source. The gate voltage of the driving transistor TR2 is approximately similar to the first power supply voltage ELVDD, and the anode voltage of the organic light emitting diode (OLED) is the sum of the voltages (about 0 to 3 V) stored in the second power supply voltage ELVSS and the organic light emitting diode (OLED), which is a voltage that is much higher than the gate voltage. Since the gate-source voltage of the driving transistor TR2 becomes a sufficiently negative voltage, the driving transistor TR2 is turned on. In this case, a current that flows through the driving transistor TR2 flows through the anode of the organic light emitting diode (OLED) at the first power source voltage ELVDD, and finally flows until the anode voltage of the organic light emitting diode (OLED) becomes identical with the first power supply voltage ELVDD.

As described above, the anode voltage of the organic light emitting diode (OLED) becomes a low voltage close to the first voltage level V1 for the reset period (a), such that the reset operation is performed.

If the reset operation is completed for the reset period (a), the first power supply voltage ELVDD is converted into the second voltage level V2.

For the compensation period (h), the scan signal S[i] is converted into the first voltage level V1 for a predetermined first period (b'), and the compensation control signal GC is converted into the first voltage level V1 for a predetermined second period (b"). The second period (b") is included in the first period (b'). In this case, the first power supply voltage ELVDD, the second power supply voltage ELVSS, and the data signal data[j] are maintained at the second voltage level V2.

As the scan signal S[i] is applied of the first voltage level V1, the switching transistor TR1 is turned on, and the data signal data[j] of the second voltage level V2 is transmitted to the input node N. In addition, as the compensation control signal GC is applied to the first voltage level V2, the compensation transistor TR3 is turned on, and the driving transistor TR2 is diode-connected. A voltage V2−VTH obtained by subtracting a threshold voltage VTH of the driving transistor TR2 from the first power supply voltage ELVDD is supplied to the gate electrode of the driving transistor TR2. In this case, the compensation capacitor Cth is charged with a voltage V2−(V2−VTH)=VTH that corresponds to a difference between the voltage V2 of the data signal data[j] and the voltage V2−VTH obtained by subtracting the threshold voltage VTH of the driving transistor TR2 from the first power supply voltage ELVDD.

As described above, the compensation operation is performed by charging the threshold voltage VTH of the driving transistor TR2 in the compensation capacitor Cth for the compensation period (b).

If the compensation operation is completed for the compensation period (b), the scan signal S[i] and the compensation control signal GC are converted into the second voltage level V2.

The switching transistor TR1 is turned on by sequentially converting a plurality of scan signals S[1] through S[n] into the first voltage level V1 for the scan period (c). While the switching transistor TR1 is turned on, the data signal data[j] is transmitted to the input node N. In this case, the first power supply voltage ELVDD and the second power supply voltage ELVSS are maintained at the second voltage level V2.

Another electrode of the compensation capacitor Cth is connected to the gate electrode of the driving transistor TR2 and is in a floating state. A change amount of the voltage of the input node N is distributed according to a volume ratio between the storage capacitor Cst and the compensation capacitor Cth, and a change amount dV of the voltage distributed in the compensation capacitor Cth is reflected in the voltage of the gate electrode of the driving transistor TR2. Accordingly, the voltage of the gate electrode of the driving transistor TR2 becomes V2−VTH+dV for the scan period (c).

As described above, the scan operation is performed by reflecting a voltage corresponding to the change amount dV of the voltage according to the data signal data[j] in the voltage of the gate electrode of the driving transistor VTH for the scan period (c).

If the light, emitting period d starts, the first power supply voltage ELVDD is converted into the second voltage level V2, and the second power supply voltage ELVSS is converted into the first voltage level V1.

The first power supply voltage ELVDD maintains the second voltage level V2 and the second power supply voltage ELVSS is decreased into the first voltage level V1 such that the driving current according to the difference between the source voltage and the gate voltage flows to the driving transistor TR2. The source voltage of the driving transistor TR2 is the first power supply voltage ELVDD of the second voltage level V2, and the gate voltage is V2−VTH+dV. The driving current of the driving transistor TR2 corresponds to a square of the voltage dV obtained by again subtracting the threshold voltage VTH from the voltage V2−(V2−VTH+dV) obtained by subtracting the gate voltage V2−VTH−dV from the source voltage V2. That is, a deviation of the data signal according to the threshold voltage deviation between the driving transistors TR2 of a plurality of pixels does not occur.

The pixel structure of FIG. 3 and the driving method of the display device of FIG. 4 are an exemplary embodiment, and the proposed power control device is not limited thereto. The proposed power control device is included in the display device including the pixel with various constitutions to supply the first power supply voltage ELVDD and the second power supply voltage ELVSS.

Figure 5:
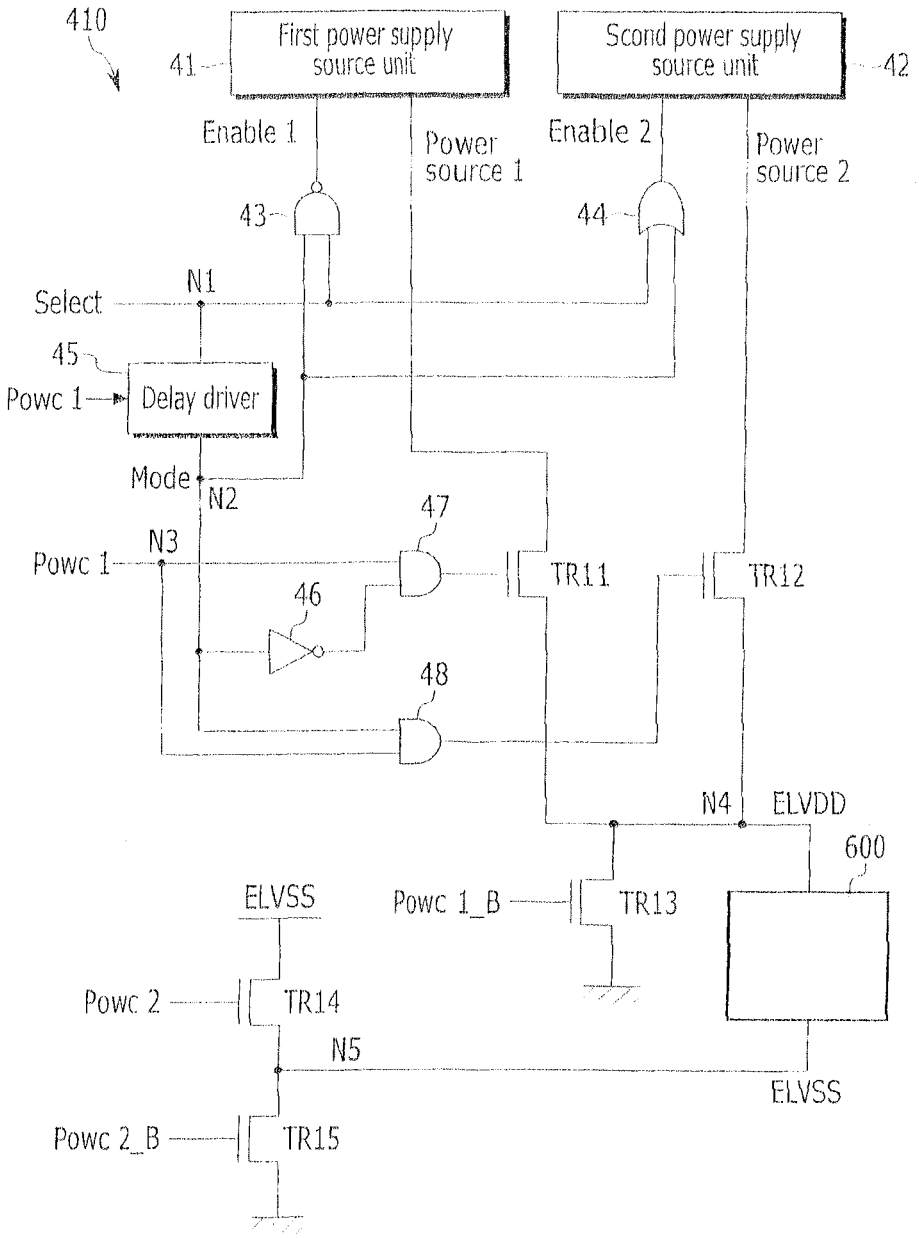
FIG. 5 is a circuit diagram of a power control device according to an exemplary embodiment of the present invention.

FIG. 5 is a circuit diagram of a power control device according to an exemplary embodiment of the present invention.

Referring to FIG. 5, the power control device 410 is included in the power supply controller 400 of FIG. 1.

The power control device 410 includes a NAND gate 43 transmitting the first enable signal Enable1 to a first power supply source unit 41, an OR gate 44 transmitting the second enable signal Enable2 to a second power supply source unit 42, a delay driver 45 delaying the selection signal Select to output a mode signal Mode, a NOT gate 46 to transmit a high power supply voltage Power source1 output from the first power supply source unit 41 as the first power supply voltage ELVDD, a first AND gate 47, a second AND gate 48 to transmit a low power supply voltage Power source2 output from the second power supply source unit 42 as the first power supply voltage ELVDD, and a plurality of transistors TR11, TR12, TR13, TR14, and TR15.

The first power supply source unit 41 is connected to the output terminal of the NAND gate 43 and is operated according to receiving of the first enable signal Enable1 from the NAND gate 43 to output a high power supply voltage Power source1.

The second power supply source unit 42 is connected to the output terminal of the OR gate 44 and is operated according to receiving of the second enable signal Enable2 from the OR gate 44 to output the low power supply voltage Power source2.

The NAND gate 43 includes the first input terminal connected to the first node N1, the second input terminal connected to the second node N2, and the output terminal connected to the first power supply source unit 41. The first node N1 is applied with the selection signal Select. The second node N2 is applied with the mode signal Mode output from the delay driver 45. The NAND gate 43 receives the selection signal Select and the mode signal Mode to generate the first enable signal. Enable1.

The OR gate 44 includes the first input terminal connected to the first node N1, the second input terminal connected to the second node N2, and the output terminal connected to the second power supply source unit 42. The OR gate 44 receives the selection signal Select and the mode signal Mode to generate the second enable signal Enable2.

The delay driver 45 is connected to the first node N1 and the second node N2, receives the selection signal Select applied to the first node N1, and outputs the mode signal Mode delayed from the selection signal Select by a predetermined time to the second node N2. At this time, the delay driver 45 monitors the first power supply voltage control signal Powc1 and may output the mode signal Mode delayed by the predetermined time to the second node N2 by using the first power supply voltage control signal Powc1. The first power supply voltage control signal Powc1 is a control signal changing the first power supply voltage ELVDD into the first voltage level V1 and the second voltage level V2 in the driving operation of the display device 10.

The delay driver 45 outputs the mode signal Mode at the time that the voltage level of the first power supply voltage ELVDD is firstly decreased from the second voltage level V2 to the first voltage level V1 after the start-up period X (shown in FIG. 6) of the first power supply source unit 41 or the second power supply source unit 42 from the time that the level of the selection signal Select is changed.

The NOT gate 46 includes the input terminal connected to the second node N2 and the output terminal connected to the first input terminal of the first AND gate 47. The NOT gate 46 generates the reverse signal of the mode signal Mode and transmits it to the first AND gate 47.

The first AND gate 47 includes the first input terminal connected to the output terminal of the NOT gate 46, the second input terminal connected to the third node N3, and the output terminal connected to the gate electrode of the first transistor TR11. The first AND gate 47 receives the reverse signal and the first power supply voltage control signal Powc1 of the mode signal Mode to generate the output signal.

The third node N3 is applied with the first power supply voltage control signal Powc1.

The second AND gate 48 includes the first input terminal connected to the second node N2, the second input terminal connected to the third node N3, and the output terminal connected to the gate electrode of the second transistor TR12. The first AND gate 47 receives the mode signal Mode and the first power supply voltage control signal Powc1 to generate the output signal.

The first transistor TR11 includes the gate electrode connected to the output terminal of the first AND gate 47, one electrode connected to the first power supply source unit 41, and the other electrode connected to the fourth node N4. The first transistor TR11 transmits the high power supply voltage of the first power supply source unit 41 to the fourth node N4 according to the output signal of the first AND gate 47.

The first power supply voltage ELVDD is supplied from the fourth node N4 to the display unit 600.

The second transistor TR12 includes the gate electrode connected to the output terminal of the second AND gate 48, one electrode connected to the second power supply source unit 42, and the other electrode connected to the fourth node N4. The second transistor TR12 transmits the low power supply voltage of the second power supply source unit 42 to the fourth node N4 according to the output signal of the second AND gate 48.

The third transistor TR13 includes the gate electrode applied with the reverse signal Powc1_B of the first power supply voltage control signal, one electrode connected to the fourth node N4, and the other electrode that is grounded. The third transistor TR13 grounds the fourth node N4 according to the reverse signal Powc1_B of the first power supply voltage control signal that is the off signal when the first power supply voltage control signal Powc1 is the on signal.

In this case, the gate electrode of the third transistor TR13 is applied with the reverse signal Powc1_B of the first power supply voltage control signal, however the gate electrode of the third transistor TR13 may be applied with a control signal that is additionally applied to control the on-off of the third transistor TR13.

The fourth transistor TR14 includes the gate electrode applied to the second power supply voltage control signal Powc2, one electrode applied with the second power supply voltage ELVSS, and the other electrode connected to the fifth node N5. The fourth transistor TR14 transmits the second power supply voltage ELVSS to the fifth node N5 according to the second power supply voltage control signal Powc2.

The second power supply voltage ELVSS is supplied from the fifth node N5 to the display unit 600.

The fifth transistor TR15 includes the gate electrode applied with the reverse signal Powc2_B of the second power supply voltage control signal, one electrode connected to the fifth node N5, and the other electrode that is grounded. The fifth transistor TR15 grounds the fifth node N5 according to the reverse signal Powc2_B of the second power supply voltage control signal that is the on signal when the second power supply voltage control signal Powc2 is the off signal.

The plurality of transistors TR11, TR12, TR13, TR14, and TR15 are n-channel field effect transistors. At this time, the gate on-voltage turning on the plurality of transistors TR11, TR12, TR13, TR14, and TR15 is the logic high level voltage and the gate off-voltage turning them off is the logic low level voltage.

Even though they are the n-channel field effect transistors, at least one among the plurality of transistors TR11, TR12, TR13, TR14, and TR15 may be a p-channel field effect transistor. At this time, the gate on-voltage turning on the p-channel field effect transistor is the logic low level voltage and the gate off-voltage turning it off is the logic high level voltage.

Figure 6:
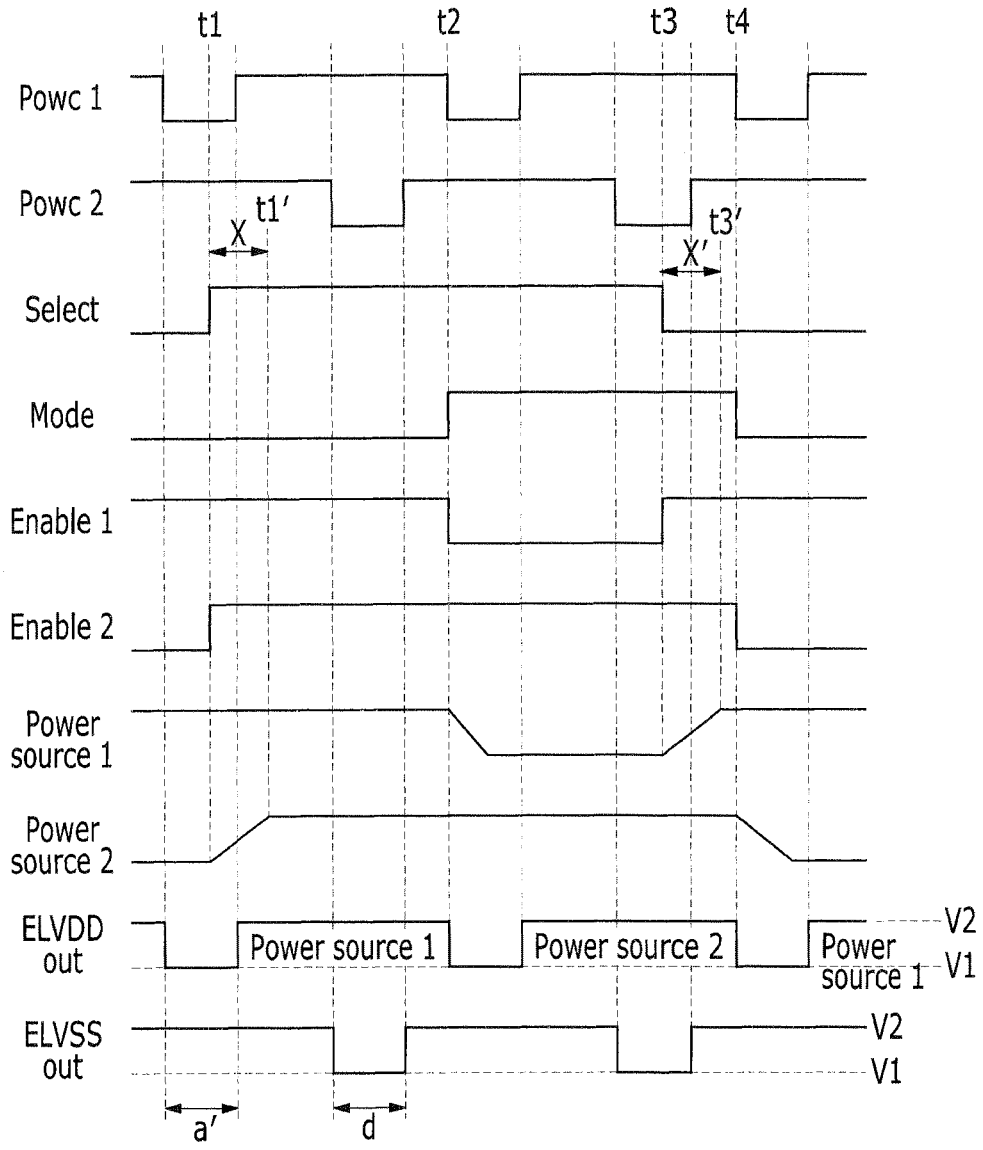
FIG. 6 is a timing diagram of a driving method of a power control device according to an exemplary embodiment of the present invention.

FIG. 6 is a timing diagram of a driving method of a power control device according to an exemplary embodiment of the present invention.

Referring to FIG. 6, the first power supply voltage control signal Powc1 is applied as the off-voltage (the logic low level voltage) during the period corresponding to the period (a') in which the first power supply voltage ELVDD is applied as the first voltage level V1, and is applied as the on-voltage (the logic high level voltage) during the rest of the period in the driving operation of the display device 10.

In the driving operation of the display device 10, the second power supply voltage control signal Powc2 is applied as the off-voltage (the logic low level voltage) during the period corresponding to the light emitting period (d) in which the second power supply voltage ELVSS is applied as the first voltage level V1, and is applied as the on-voltage (the logic high level voltage) during the rest of the period.

If the second power supply voltage control signal Powc2 is applied as the logic high level voltage, the fourth transistor TR14 is turned on such that the second power supply voltage ELVSS is transmitted to the fifth nodeN5. If the second power supply voltage control signal Powc2 is applied as the logic low level voltage, the fourth transistor TR14 is turned off, and the fifth transistor TR15 is turned on by the reverse signal Powc2_B of the power supply voltage control signal applied with the logic high level voltage such that the fifth node N5 is grounded.

The first power supply voltage control signal Powe1 and the second power supply voltage control signal Powc2 may be included in the third driving control signal CONT3 transmitted from the signal controller 100 to the power supply controller 400.

If the first power supply voltage control signal Powc1 is applied with the logic low level voltage, the first AND gate 47 and the second AND gate 48 output the logic low level voltage, and the first transistor TR11 and the second transistor TR12 are turned off. At this time, the reverse signal Powe1_B of the first power supply voltage control signal is applied with the logic high level voltage such that the third transistor TR13 is turned on. The fourth node N4 is grounded such that the first power supply voltage ELVDD supplied to the display unit 600 is decreased to the first voltage level V1.

If the first power supply voltage control signal Powc1 is applied with the logic high level voltage, one of the first transistor TR11 and the second transistor TR12 is turned on according to the mode signal Mode, and the fourth node N4 is transmitted with one of the high power supply voltage Power source1 of the first power supply source unit 41 and the low power supply voltage Power source2 of the second power supply source unit 42. At this time, the reverse signal Powe1_B of the first power supply voltage control signal is applied with the logic low level voltage to turn off the third transistor TR13.

The selection signal Select, as the signal instructing the conversion of the power supply source, may be a signal input by the user or a signal that is automatically input according to a predetermined condition according to the characteristic of the image. The selection signal Select of the logic low level voltage may be the signal instructing the driving of the general mode using the high power supply voltage Power source1 of the first power supply source unit 41. The selection signal Select of the logic high level voltage may be the signal instructing the driving of the power saving mode using the low power supply voltage Power source2 of the second power supply source unit 42.

If the selection signal Select is applied with the logic low level voltage, the NAND gate 43 transmits the first enable signal Enable1 to the first power supply source unit 41. The first power supply source unit 41 is operated according to the first enable signal Enable1 such that the high power supply voltage Power source1 is output. The first enable signal Enable1 of the on-voltage operating the first power supply source unit 41 has the logic high level voltage. The first enable signal Enable1 of the off-voltage as the logic low level voltage stops the operation of the first power supply source unit 41.

Also, if the selection signal Select is applied with the logic high level voltage, the OR gate 44 transmits the second enable signal Enable2 to the second power supply source unit 42. The second power supply source unit 42 is operated according to the second enable signal Enable2 to output the low power supply voltage Power source2. The second enable signal Enable2 operating the second power supply source unit 42 has the logic high level voltage. The second enable signal Enable2 when switched to the logic low level voltage stops the operation of the second power supply source unit 42.

When the selection signal Select is applied with the logic low level voltage, the second enable signal Enable2 is delayed by the delay driver 45 and is decreased to the logic low level voltage at the time that the output mode signal Mode is changed into the logic low level voltage. That is, the OR gate 44 outputs the second enable signal Enable2 as the logic low level voltage at the time that the selection signal Select and the mode signal Mode are applied with the logic low level voltage. If the second enable signal Enable2 is applied with the logic low level voltage, the operation of the second power supply source unit 42 is stopped.

When the selection signal Select is applied with the logic high level voltage, the first enable signal Enable1 is delayed by the delay driver 45 and is decreased to the logic low level voltage at the time that the output mode signal. Mode is changed into the logic high level voltage. That is, the NAND gate 43 outputs the first enable signal Enable1 as the logic low level voltage at the time that the selection signal Select and the mode signal Mode are applied with the logic high level voltage. The operation of the first power supply source unit 41 is stopped if the first enable signal Enable1 is applied with the logic low level voltage.

For example, it is assumed that the selection signal Select is changed from the logic low level voltage to the logic high level voltage at the time t1 (referred to as a start time), and the start-up period of the second power supply source unit 42 is referred to as X shown in FIG. 6.

As the selection signal Select is applied with the logic high level voltage at the time t1, the OR gate 44 outputs the second enable signal Enable2 to operate the second power supply source unit 42. The start-up of the second power supply source unit 42 is completed at the time t1' (referred to as a start-up-end time) after the start-up period X. The delay driver 45 monitors the first power supply voltage control signal Powc1 to output the mode signal Mode as the logic high level voltage at the time t2 (referred to as a switching time), and the first power supply voltage ELVDD is decreased to the first voltage V1 after the time t1'.

The mode signal Mode is the logic low level voltage before the time t2 such that the first enable signal Enable1 is output as the logic high level voltage, and the first power supply source unit 41 maintains the operation state. Also, the mode signal Mode is the logic low level voltage before the time t2 such that the second transistor TR12 maintains the off state and the first transistor TR11 is turned on/off according to the first power supply voltage control signal Powc1 to transmit the high power supply voltage Power source1 to the fourth node N4.

The mode signal Mode is the logic high level voltage after the time t2 such that the first enable signal Enable1 is output as the logic low level voltage and the operation of the first power supply source unit 41 is stopped. Also, the mode signal Mode is the logic high level voltage after the time t2 such that the first transistor TR11 maintains the off state and the second transistor TR12 is turned on/off according to the first power supply voltage control signal Powc1, and thereby the low power supply voltage Power source2 is transmitted to the fourth node N4.

That is, the power supply source is converted from the first power supply source unit 41 to the second power supply source unit 42 at the switching time t2, at which the voltage Power source1 from the first power supply source unit 41 is firstly decreased as the first power supply source unit 41 stops operation. The switching time t2 is delayed by a predetermined time period from the start-up-end time t1', at which the second power supply source unit 42 starts a normal operation. The start-up-end time t1' is right after the start-up period X of the second power supply source unit 42. The start-up period X starts from the time t1, at which the selection signal Select is changed to the logic high level voltage. At time t2, at which the power supply source is switched, the operation of the first power supply source unit 41 is stopped, and the power consumption may be reduced.

Next, it is assumed that the selection signal Select is changed from the logic high level voltage to the logic low level voltage at the time t3, and the start-up period of the first power supply source unit 41 is referred to as X'. The time t3 can be referred to as a start time of the first power supply source unit 41.

As the selection signal Select is applied with the logic low level voltage at the time t3, and the NAND gate 43 outputs the first enable signal Enable1 to operate the first power supply source unit 41. The start-up of the first power supply source unit 41 is completed at the time t3' after the time X'. The delay driver 45 monitors the first power supply voltage control signal Powc1 to output the mode signal Mode as the logic low level voltage at the time t4 of the time that the first power supply voltage ELVDD is firstly decreased to the first voltage V1 after the time t3'. The time t3' can be referred to as a start-up-end time of the first power supply source unit 41, and the time t4 can be referred to as another switching time.

As the mode signal Mode is the logic high level voltage from the time t2 to the time t4, the first transistor TR11 maintains the off state and the second transistor TR12 is turned on/off according to the first power supply voltage control signal Powe1 such that the low power supply voltage Power source2 is transmitted to the fourth node N4.

As the mode signal Mode is the logic low level voltage after the time t4, the second enable signal Enable2 is output with the logic low level voltage such that the operation of the second power supply source unit 42 is stopped. Also, as the mode signal Mode is the logic low level voltage after the time t4, the second transistor TR12 maintains the off state and the first transistor TRH is turned on/off according to the first power supply voltage control signal Powe1 such that the high power supply voltage Power source1 is transmitted to the fourth node N4.

That is, the power supply source is converted from the second power supply source unit 42 to the first power supply source unit 41 at the time t4 that the first power supply voltage ELVDD is firstly decreased to the first voltage level V1 from the time t3' after the start-up period X' of the first power supply source unit 41 after the time t3 when the selection signal Select is changed into the logic low level voltage. The operation of the second power supply source unit 42 is stopped at the time t4 that the power supply source is converted such that the power consumption may be reduced.

As described above, the time that the power supply source is converted is controlled by using the delay driver 45 such that the instant that the power supply source of the display device 10 is converted being recognized by the eye of the user may be prevented.

The drawings referred to hereinabove and the detailed description of the disclosed invention are presented for illustrative purposes only, and are not intended to define meanings or limit the scope of the present invention as set forth in the following claims. Those skilled in the art will understand that various modifications and equivalent embodiments of the present invention are possible. Consequently, the true technical protective scope of the present invention must be determined based on the technical spirit of the appended claims.

What is claimed is:

1. A display device comprising:

a plurality of pixels; and a power supply controller transmitting a high power supply voltage and a low power supply voltage to the plurality of the pixels, the power supply controller comprising:

a first power supply source unit supplying the high power supply voltage;

a second power supply source unit supplying the low power supply voltage, the high power supply voltage being different from the low power supply voltage, the power supply controller connecting one of the first and second power supply source units to the plurality of the pixels, the one of the first and second power supply source units being switched to another of the first and second power supply source units at a switching time at which the one of the first and second power supply source units stops operation, the switching time being after a start time of said another of the first and second power supply source units at which said another of the first and second power supply source units starts operation, said another of the first and second power supply source units having a start-up period after the start time, the switching time being after the start-up period of said another of the first and second power supply source units; and a delay driver receiving a selection signal and outputting a mode signal, a level change of the mode signal being delayed from a level change of the selection signal, the start time of said another of the first and second power supply source units being a time at which the selection signal is changed into a level for selecting said another of the first and second power supply source units, the switching time being a time at which a logic level of the mode signal changes.

2. The display device of claim 1, wherein the one of the first and second power supply source units starts operation at a time that the selection signal is changed into a level for selecting the one of the first and second power supply source units.

3. The display device of claim 2, wherein the operation of the one of the first and second power supply source units stops at a time that a level of the power supply voltage of the one of the first and second power supply source units begins to decrease.

4. The display device of claim 1, wherein the operation of said another of the first and second power supply source units stops at the time that a level of the power supply voltage of said another of the first and second power supply source units begins to decrease.

5. The display device of claim 1, wherein a level of the power supply voltage of the one of the first and second power supply source units begins to decrease at the switching time, a driving voltage of an organic light emitting diode (OLED) included in the plurality of pixels being reset at the switching time.

6. A power control device comprising:

a delay driver receiving a selection signal and outputting a mode signal delayed from the selection signal;

a NAND gate receiving the selection signal and the mode signal to generate a first enable signal;

a first power supply source unit receiving the first enable signal and outputting a high power supply voltage as a first power supply voltage to a display unit;

an OR gate receiving the selection signal and the mode signal to generate a second enable signal; and a second power supply source unit receiving the second enable signal and outputting a low power supply voltage as the first power supply voltage to the display unit.

7. The power control device of claim 6, wherein the delay driver monitors a first power supply voltage control signal that triggers the first power supply voltage to change into a logic low level or a logic high level, and outputs the mode signal delayed from the selection signal by using the first power supply voltage control signal.

8. The power control device of claim 6, wherein the delay driver outputs the mode signal at the time that the level of the first power supply voltage is decreased after a predetermined time from the time that the level of the selection signal is changed.

9. The power control device of claim 8, wherein the predetermined time is a start-up period during which the voltage of the first power supply source unit is increased.

10. The power control device of claim 9, wherein the first enable signal changes from a level to another level at the time that the level of the selection signal is changed.

11. The power control device of claim 10, wherein the first enable signal changes from said another level to the level stopping the operation of the first power supply source unit at the time that the first power supply voltage level is decreased.

12. The power control device of claim 8, wherein the predetermined time is a start-up period during which the voltage of the second power supply source unit is increased.

13. The power control device of claim 12, wherein the second enable signal changes from a level to another level at the time that the level of the selection signal is changed.

14. The power control device of claim 13, wherein the second enable signal changes from said another level to the level stopping the operation of the second power supply source unit at the time that the first power supply voltage level is decreased.

15. The power control device of claim 6, further comprising:

a NOT gate generating a reverse signal of the mode signal;

a first AND gate receiving the reverse signal of the mode signal and the first power supply voltage control signal to change the first power supply voltage into the logic low level and the logic high level to generate the first output signal; and a first transistor transmitting the high power supply voltage of the first power supply source unit to the first node supplying the first power supply voltage to the pixel according to the first output signal of the first AND gate.

16. The power control device of claim 15, wherein the first power supply voltage control signal is applied with an off-voltage during a reset period for reversing a voltage difference of the first power supply voltage and the second power supply voltage to reset the driving voltage of the organic light emitting diode (OLED) included in the pixel.

17. The power control device of claim 15, further comprising:

a second AND gate receiving the mode signal and the first power supply voltage control signal to generate the second output signal; and a second transistor transmitting the low power supply voltage of the second power supply source unit to the first node according to the second output signal of the second AND gate.

18. The power control device of claim 17, further comprising a third transistor grounding the first node supplying the first power supply voltage to the pixel according to the reverse signal of the first power supply voltage control signal.

19. The power control device of claim 18, further comprising:

a fourth transistor transmitting the second power supply voltage to the second node supplying the second power supply voltage to the pixel according to the second power supply voltage control signal to change the second power supply voltage to provide the pixel driving current into the logic low level and the logic high level; and a fifth transistor grounding the second node according to the reverse signal of the second power supply voltage control signal.

20. The power control device of claim 19, wherein the second power supply voltage control signal is applied with an off-voltage during a light emitting period for light-emitting the pixel.

21. A driving method of a power control device comprising:

supplying a first power supply voltage and a second power supply voltage providing a driving current of a plurality of pixels to the plurality of pixels, one of power supply source units supplying the first power supply voltage;

changing a level of a selection signal instructing a conversion of the power supply source units at which the first power supply voltage is supplied from another of the power supply source units;

starting an operation of said another of the power supply source units at a time that the level of the selection signal is changed;

changing a level of a mode signal after a predetermined time from the changing the level of the selection signal;

converting the power supply source units from the one of power supply source units to said another of the power supply source units at a time that the level of the mode signal is changed, a level of the power supply voltage of the one of the power supply source units is decreased at a time that the level of the mode signal is changed.

22. The driving method of claim 21, wherein the one of the power supply source units outputs a high power supply voltage, and said another of the power supply source units outputs a low power supply voltage.

23. The driving method of claim 22, further comprising stopping the operation of the one of the power supply source units at the time that the level of the mode signal is changed.

24. The driving method of claim 21, wherein the converting of the power supply source units includes:

reversing a voltage difference of the first power supply voltage and the second power supply voltage to reset the driving voltage of the organic light emitting diode (OLED) included in a plurality of pixels.

25. The driving method of claim 21, wherein the predetermined time is greater than a start-up period during which a voltage level of said another of the power supply source units is increasing.

* * * * *